US006550999B2

(12) United States Patent
Petit et al.

(10) Patent No.: US 6,550,999 B2
(45) Date of Patent: Apr. 22, 2003

(54) DISPENSER WITH DISENGAGEABLE SCREW MECHANISM

(75) Inventors: Robert Petit, Chevilly-Larue (FR); Gerard Rascol, Chevilly-Larue (FR)

(73) Assignee: LIR France, Chevilly-Larue (FR)

( * ) Notice: Subject to any disclaimer, the term of this patent is extended or adjusted under 35 U.S.C. 154(b) by 0 days.

(21) Appl. No.: 09/827,328

(22) Filed: Apr. 6, 2001

(65) Prior Publication Data

US 2002/0006305 A1 Jan. 17, 2002

(30) Foreign Application Priority Data

Apr. 6, 2000 (FR) ..... 00 04425

(51) Int. Cl.[7] ..... A45D 40/04
(52) U.S. Cl. ..... 401/70; 401/68; 401/75
(58) Field of Search ..... 401/68, 69, 70, 401/76, 172, 175

(56) References Cited

U.S. PATENT DOCUMENTS

| | | | | |
|---|---|---|---|---|
| 2,815,123 A | * | 12/1957 | Safianoff | 401/70 |
| 3,612,705 A | | 10/1971 | Duval | |
| 4,369,158 A | | 1/1983 | Woodruff et al. | |
| 5,407,286 A | * | 4/1995 | Powers | 401/70 |
| 5,733,058 A | | 3/1998 | Hofmann | |
| 5,868,510 A | | 2/1999 | Lacout et al. | |

FOREIGN PATENT DOCUMENTS

| | | |
|---|---|---|
| FR | 1519560 | 8/1966 |
| FR | 2573734 | 5/1986 |
| JP | 8154736 | 6/1996 |

* cited by examiner

*Primary Examiner*—David J. Walczak
(74) *Attorney, Agent, or Firm*—Dennison, Schultz & Dougherty

(57) ABSTRACT

The dispenser (1) includes a body (2), a cap (11), a propellant device (3) including a base plate (4) with an axial screw (5), fixed on said base plate, a plunger (6) formed of a medium (8) of said stick and of a central nut (7), engaging by screwing with the axial screw, a bottom (12) and/or a knob for rotating the axial screw, and is characterized in that:

a) engagement between the thread (50) of the screw (5) and the thread (70) of the nut (7) is partial, one of the two threads extending only over a predetermined angular fraction, so as to form a so-called partial thread, b) the central nut (7) and/or the axial screw (5) include a radial resilience means, constituting an aptitude for radial distortion under stress, so as to allow, in the event of forced rotation under stress and of locking of the screw relative to the nut, a disengagement, i.e. a relative axial movement of the "male" and "female" spirals, by overlap of the spirals and clearance of a screw thread, without destroying the engagement between screw and nut.

22 Claims, 4 Drawing Sheets

DISPENSER WITH DISENGAGEABLE SCREW MECHANISM

FIELD OF THE INVENTION

The invention relates to the field of cosmetic product dispensers in the form of and known as "sticks", the cosmetic products thus dispensed being typically of the pasty type and most often deodorants.

PRIOR ART

Known dispensers include most often:

- a body forming a skirt or a side wall containing a cosmetic product propellant device, and open at two ends, the cosmetic product having to rise to the surface at an upper end in order to be applied,
- a cover or a cap closing, typically in a sealing way, the upper end,
- a bottom, either fixed to the body, or integral with the propellant device,
- a propellant device typically includes two parts mobile one relative to the other, one being constituted by a plunger in the form of a nut adjusted to the shape of the body, the plunger, which bears the cosmetic product, being typically moveable axially but not in rotation, either due to the non cylindrical shape of the body, or, if the body is cylindrical, by engagement of at least one axial rib carried on the inner surface of the body and of at least one groove formed on the periphery of the plunger, the other including typically the following components, possibly in the form of a part cast in a single piece:
  - a base plate fixed to the body as far as axial movement is concerned, but free in rotation, the fixing to the body being made typically by clipping or snapping on,
  - a threaded screw, integral with the base plate, carrying and engaging with the plunger forming a nut,
  - a screw drive knob, which may possibly be constituted by the bottom itself, allowing the user to move the stick form cosmetic product axially, and therefore to bring it up to the upper orifice of the body, as it is consumed.

In a known way, the plunger and the base plate have apertures which allow the dispenser to be filled through the bottom, the dispenser being closed by its sealed cover.

Also in a known way, the dispenser is formed by assembly, particularly by snapping on or by clipping, of the propellant device in the body, the other parts of the dispenser being also generally assembled in this way, reversibly as regards the cover, and irreversibly as regards the bottom or the knob activating said screw.

Thus, as examples of patents describing dispensers may be cited French patent no. 2 573 734 or again European patent no. 462 925.

Problems Posed

As already indicated, known dispensers include a plunger forming the cosmetic product stick medium, which is forced into an axial movement as soon as the user rotates the screw, by subjecting the bottom or a knob provided for this purpose to a rotation relative to the dispenser body.

Sometimes dispensers carry an indication, by means for example of a printed arrow, of the so-called "positive" direction in which it is appropriate to rotate the bottom or the knob so as to bring the plunger up.

But most often, dispensers carry no such indication, an indication of this kind, although practical in nature, being of no particular help in giving the dispenser a "top of the range" product image or in improving its appearance.

Furthermore, even if dispensers were to carry this indication of the "positive" rotation direction, this indication would not necessarily be observed, given the variety of situations in everyday life, since these dispensers can fall into the hands of children who play with any object which comes to hand, or adults who pay little attention to the indications carried by the packaging, or else people tempted to go against what is indicated, just to "see what might happen" etc.

In all these circumstances, there is a risk of seeing a rotation forced on said screw, while the plunger-nut is locked, in the down position after rotation in the "negative" direction, which will irreversibly damage the "screw-nut" unit.

A solution to this problem is already known from U.S. Pat. No. 5,733,058 in the case of a top filling dispenser. This dispenser includes particularly a partially threaded central screw (denoted by the reference 14) and a stick medium (denoted by the reference 16) which includes a trough integral with a threaded nut engaging with said screw, said threaded nut being of a flexible material able to distort under stress in the event of locking of said trough relative to said screw.

However, on the one hand, this patent does not bring a solution in the case of current bottom filling dispensers, on the other hand, if this patent does disclose an idea, it does not necessarily teach how to form a nut which would be "hard" enough to fulfil its "normal" function which is to make the stick move up or down, and which would be "supple" or "soft" enough to fulfil its "occasional" function which is to distort when the central screw is rotated in the wrong direction and when the stick medium is at a stop. There is no evidence that a satisfactory compromise exists of a nut able to fulfil these two functions even in the case of a top filling dispenser.

Additionally, using a "soft" material for the nut presents the obvious risk of causing damage to the inner thread of the nut.

Lastly, in the case of bottom filling dispensers, the stick medium, which is typically a part cast in a single piece, must furthermore be a fairly rigid part, which is not compatible with the material flexibility required by the solution described in U.S. Pat. No. 5,733,058.

Means intended to resolve a similar problem are furthermore known in other types of packaging, lipstick tubes in French patent No. 1.519.560, a mascara tube in Japanese patent No. 08 154736, but they are not adapted to the case of a dispenser according to the present invention.

The purpose of the invention is therefore to find a solution to the problem posed which may be used in a bottom loader dispenser, which is technically reliable, and which, in terms of mass production, gives sufficient latitude to obtain consistent production quality.

Incidentally, the purpose of the invention is to provide an audio means of alerting the user and of inviting him to change the direction of rotation of the drive knob or of the bottom as the case may be.

OBJECT OF THE INVENTION

The object of the invention is a dispenser which resolves the problems posed, in such a way that the user cannot destroy the engagement between the screw and the plunger, an engagement of the "screw-nut" type, however the dispenser is handled.

DESCRIPTION OF THE INVENTION

According to the invention, the typically cosmetic product dispenser in stick form includes a body, a cap, a propellant device including a base plate fixed to said body, and an axial, spiral or so-called "male" helical threaded screw, fixed on said base plate, a plunger formed of a medium of said stick and of a central, spiral or so-called "female" threaded nut, engaging by screwing with said axial screw, a bottom and/or a knob for rotating said screw, said medium and said body possibly including axial guide means, typically by engagement of at least one axial rib on the inner surface of said body with at least one axial groove on the periphery of said medium, so as to provide, in the case of a cylindrical dispenser, axial movement of said stick by rotation of said knob or of said bottom, and is characterised in that:

a) engagement between the so-called "male" helical thread and the so-called "female" thread is partial, one of the two threads extending only over a predetermined angular fraction, so as to form a so-called partial thread, b) said central nut and/or said axial screw include a radial resilience means, constituting an aptitude for radial distortion under stress, so as to allow, in the event of forced rotation under said stress and of locking of said screw relative to said nut, a disengagement, i.e. a relative axial movement of the "male" and "female" spirals, by overlap of the spirals and clearance of a screw thread, without destroying said engagement between screw and nut, c) said base plate (4) and said medium (8) of said stick are open-worked so as to allow said dispenser to be filled through the bottom, d) said medium (8) includes radial platelets (80) fixed to said central nut (7) which has, in the sectors between said radial platelets (80), a thinned down wall (72).

In this way, the applicant company has been able to observe that, thanks to this combination of means, it was possible to fix at a pre-determined level a disengagement torque value between screw and nut, i.e. the value of the torque which leads, following a locking of the rotation between screw and nut being locked—particularly when the nut reaches the bottom end of the screw integral with the base plate, to the spirals overlapping and to their being axially offset. It is important to have this possibility of varying this level since it must be positioned between two thresholds:

on the one hand, a lower so-called use threshold, corresponding to the "standard" torque under "normal" conditions of use of the dispenser, which may vary according to the packaged cosmetic product, and on the other hand, an upper so-called break threshold corresponding to a torque causing damage to the dispenser or to the screwing threads of the screw-nut unit, a threshold which will vary particularly with the mechanical characteristics and/or the thickness of the materials used to form the dispenser.

Thus, with the invention, the user will never be able to apply to the dispenser a torque equal to the break torque, since well before this threshold is reached, an overlap of spirals will have occurred—without destruction of the spirals—in respect of a pre-determined torque value, thanks to the means of the invention—this is what is termed "disengagement" between screw and nut.

Generally speaking, a new 360° rotation produces an overlap of one spiral, with the result that the user is able to realise that the direction of rotation should be reversed. The invention therefore brings total safety to the use of dispensers, even if they fall into inexpert hands which might inadvertently apply to the dispenser far too high a torque.

DESCRIPTION OF FIGURES

All the figures relate to the invention.

FIGS. 2*a* to 3*b* relate essentially to the plunger (6).

FIG. 2*a* is a view from above, along a horizontal plane perpendicular to the axis (10).

FIG. 3*b* is, for the part located on the left of the axis (10), an enlargement of the part of FIG. 2*b* surrounded by dots, the part located to the left of the axis (10) showing, in side perspective, a portion of the axial screw (5) with its thread characterised particularly by its "up" gradients (500) of angle $\gamma$ and "down" gradients (501) of angle $\gamma'$, the corresponding "up" and "down" (701) gradients of the thread (70) of the central nut (7) having an angle equal to $-\gamma'$ and $-\gamma$.

DETAILED DESCRIPTION OF THE INVENTION

Figures 1, 1A:
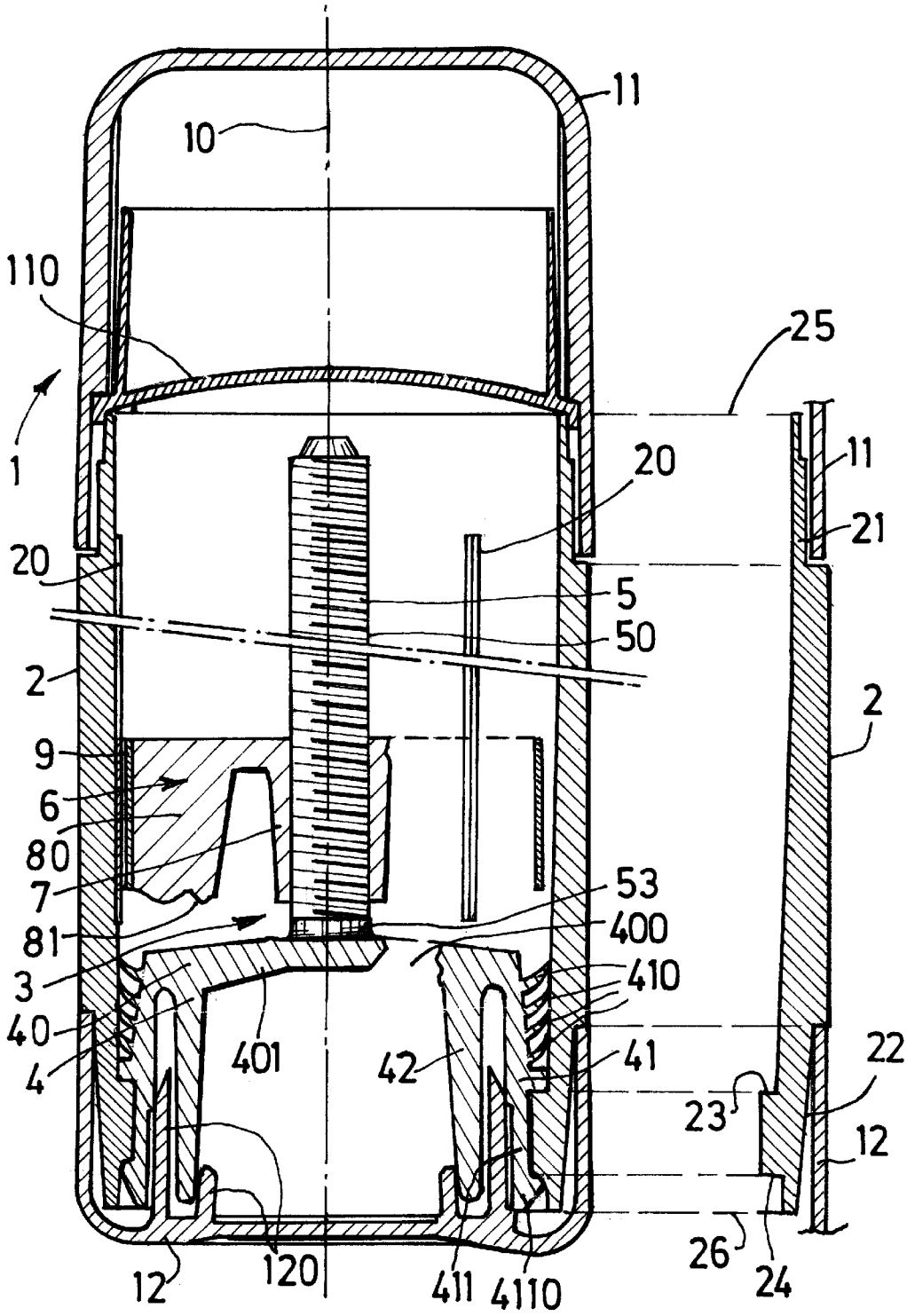
FIG. 1 is a view of the dispenser (1), in axial cross-section along the vertical axis (10) of the dispenser.
FIG. 1*a* is a partial cross-section of the dispenser (1) in FIG. 1.

According to the invention, said axial screw (5) or the central nut (7) may include a partial thread.

According to one form of the invention, said axial screw (5) may include a partial "male" thread (51) formed on a threaded cylinder typically truncated by an axial plane or by two parallel axial planes (52).

Figure 4A:
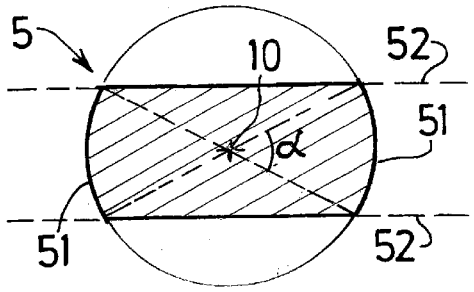
FIGS. 4*a* to 4*d* show, in cross-section along a horizontal plane perpendicular to the axis (10), sections of axial screw (5) with partial thread (71).
Figure 4B:
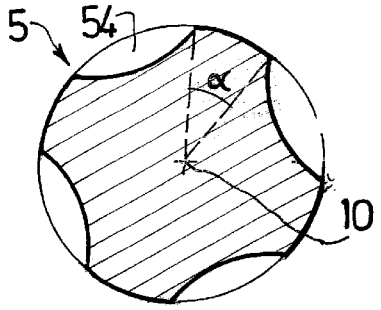
Figure 4C:
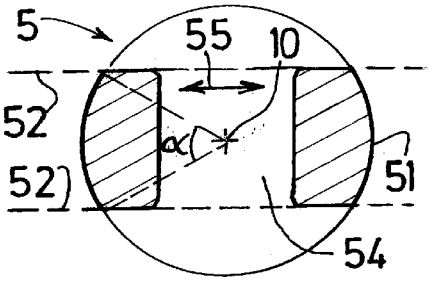
Figure 4D:
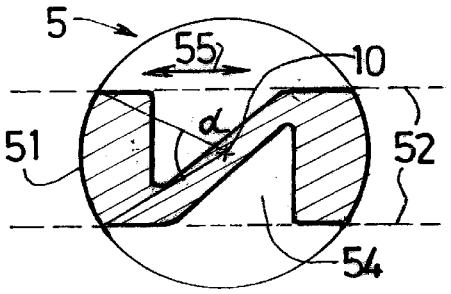

This form is shown in FIGS. 4*a* to 4*d* as non-restrictive examples of axial screws (5) with partial thread (51):

the thread (51) has an angular extent equal to $2\alpha$ in FIGS. 4*a*, 4*c* and 4*d* while the angular extent is equal to 4*a* in FIG. 4*b*, the thread is delimited by parallel planes (52) in the case of FIGS. 4*a*, 4*c* and 4*d*, while it is delimited by recesses (54) in the case of FIG. 4*b*.

According to another form of the invention, said central nut (7) may include a partial "female" thread (71) formed on a cylinder typically truncated by several concurrent axial planes along the axis of symmetry (10) of said dispenser, the angular non threaded part being recessed.

Figure 6:
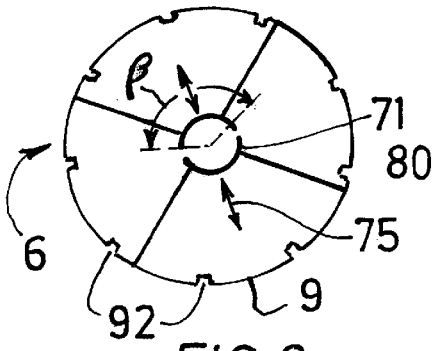
FIG. 6, similar to FIG. 2*a*, shows another form of plunger.
Figure 5A:
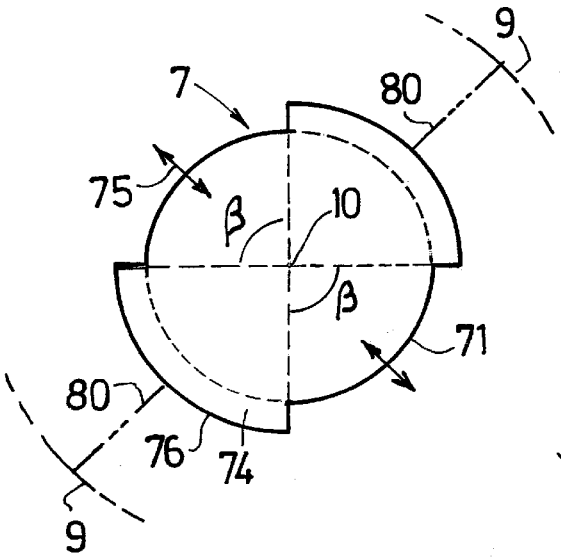
FIGS. 5*a* to 5*b* show, in cross-section along a horizontal plane perpendicular o the axis (10) sections of central nut (7) with partial thread (71).
Figure 5B:
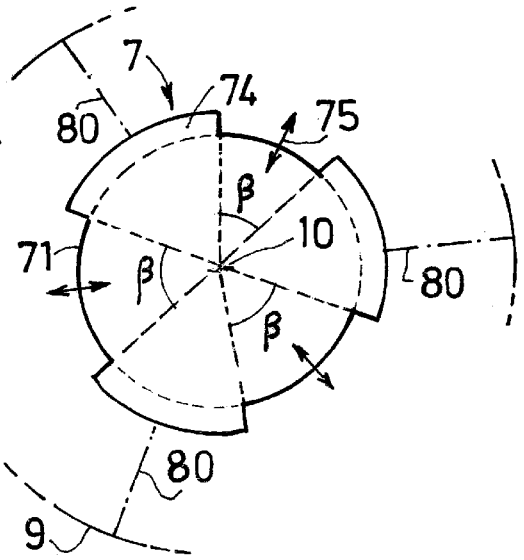

FIGS. 5*a*, 5*b* and 6 show this form: the partial thread (71) has one angular range equal to $2\beta$ in the case of FIGS. 5*a* and 6, of $3\beta$ in the case of FIG. 5*b*.

According to the invention, as already mentioned, said nut and/or said axial screw can carry radial resilience means, so as to allow an overlap of threads also called for disengagement of the threads, for a pre-determined level of rotational torque.

According to a form of the invention, said central nut (7) may include said radial resilience means, the nature and thickness of the materials being selected so as to provide the desired level of radial resilience (55).

Figure 3B:
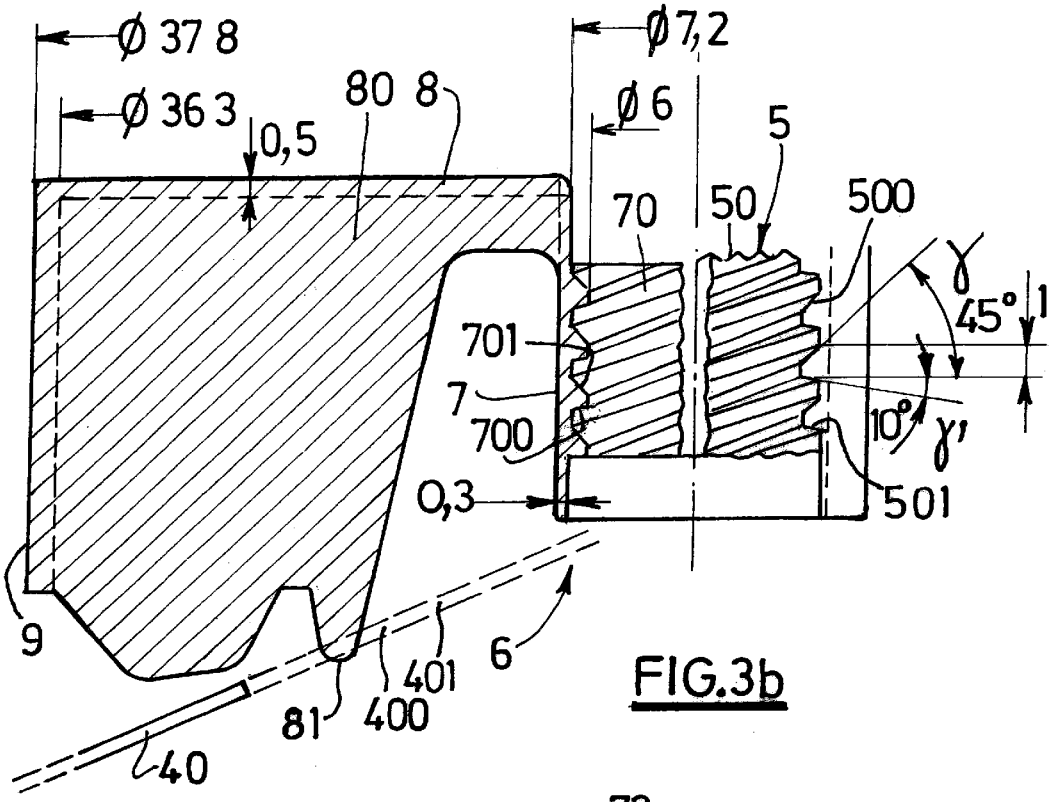
Figure 3A:
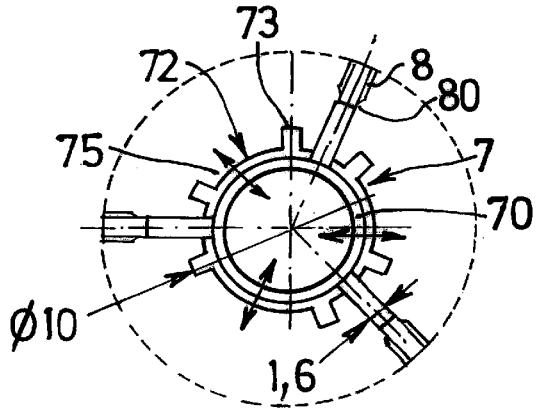
FIG. 3*a*, similar to FIG. 2*a*, corresponds to an enlargement of the central part of the plunger in FIG. 2*a*.

To this end, said medium (8) typically including radial platelets (80) fixed to said central nut (7), said central nut (7) may have in the sectors between said radial platelets (80) a thinned down wall (72) of a thickness selected so as to form said radial resilience means (75), so as to allow said overlap of spirals or threads, as has been shown in FIG. 3*a*.

In this case, said thinned down wall (72) may include axial reinforcements (73).

According to a form of the invention shown in FIGS. 5*a*, 5*b* and 6, said central nut (7) may include simultaneously said partial "female" thread (71) and said radial resilience means, typically thanks to one or more recesses (74) which allow a certain radial resilience (75) of the partially threaded portions (71).

In these figures, the radial platelets (80) are carried by the non threaded portions (76) of the nut (7) so as not to reduce the radial resilience of the threaded parts (71).

According to what is shown in FIGS. 5*a* and 5*b*, the threaded parts (71) are more rigid than the non threaded parts (76).

In FIG. 6, the two threaded portions (71) are distinct and maintained opposite by the radial platelets (80).

According to another form, said axial screw (5) may include said radial resilience means. Thus, said axial screw (5) may be open-worked in the axial direction, typically thanks to a recess (54), so as to allow sufficient radial resilience (55) to allow the disengagement of the screw-nut unit.

Said axial screw (5) may include simultaneously said partial "male" thread (51) and said radial resilience means, as has been shown, by way of example, in FIGS. 4*c* and 4*d*.

According to the invention, said pre-determined angular fraction ($\alpha$, $\beta$), over which said engagement extends, may typically be between 0.2 and 0.6, but it may go further up to about 0.8.

This fraction is of about 0.3 in FIGS. 4*a*, 4*c* and 4*d*, of 0.5 in FIGS. 4*b*, 5*a* and 5*b*, and of 0.8 in FIG. 6.

Said angular fraction ($\alpha$, $\beta$) may be shared out angularly, in an even way, so as to obtain an axial symmetry of about 2, 3, 4 or 5.

The axial symmetry is of 2 in the case of FIGS. 4*a*, 4*c*, 4*d*, 5*a* and 6, of 3 in the case of FIG. 5*b* and of 4 in the case of FIG. 4*b*.

According to an advantageous form of the invention, in the event of said axial screw (5) locking relative to said central nut (7) integral with said medium (8), the central nut (7) having reached the lower end (53) of said axial screw (5), said forced rotation of said axial screw (5) relative to said medium (8) may entail the transitory passing of a flexible component, typically carried by said medium (8), over a raised component typically carried by said base plate (4), tensioning said flexible component then releasing it after passing said raised component, given the axial bringing together of said medium (8) and said base plate (4), and lead to the emission of an audible sound constituting an audio alert deterring the continuation of rotation in this same direction.

To that end, said medium (8) may be open-worked and include radial platelets (80) integral with a circular belt (9), each radial platelet (80) carrying on its lower part a flexible tab (81), and said base plate (4) may include a ceiling (40) with radial arms (401) delimiting open-worked sectors, arms which, forming said raised component, obstruct the passage of said flexible tab (81), make it vibrate during its forced passage resulting from said forced rotation and thus lead to said emission of an audible sound.

FIG. 1 makes it possible to display this form: it is easy to see that, when the plunger (6) reaches the lower end (53) of the axial screw (5), then the end of the flexible tab (81) will bend and be tensioned when it is opposite the radial arms (401), then be released with an emission of sound, in the manner of a rattle, when it is opposite the open-worked sectors (400) of the base plate (4).

According to an alternative of the invention, said thread (50, 70) may be a so-called "artillery thread", the "up" gradients $\gamma$ (500, 700) and the "down" gradients $\gamma'$ (501, 701) of a characteristic cross-section of the thread of the axial screw (5) and of the central nut (7) being selected so as to provide simultaneously a thrust in the screw direction in respect of using the cosmetic product and to facilitate said screw thread clearance in the event of "down" locking of said axial screw (5) relative to said nut (7), at the lower end of said screw.

Said up gradient $\gamma$ (500) of said thread (50) may be between 40 and 50° and said down gradient $\gamma'$ (501) of said thread (50) may be between −5 and −15°, the corresponding up gradient (700) of said thread (70) being equal to $-\gamma'$ and the corresponding down gradient (701) of said thread (70) being equal to $-\gamma$.

Said up gradient $\gamma$ (500) may typically have a value of 45°+/−1° and said down gradient $\gamma'$ (501) −10°+/−1°.

This alternative, which has been shown in FIG. 3*b*, amounts to facilitating the disengagement of the plunger (6) relative to the axial screw (5) in one direction rather than the other. In the case shown in FIG. 3*b*, the rotation of the axial screw (5) and its disengagement, is facilitated when the plunger is locked at the lower end (53) of the axial screw (5).

But said thread (50, 70) may also be a "standard" thread, with "up" gradients (500, 700) and "down" gradients (501, 701) typically identical in absolute value, such that the disengagement of the screw relative to the plunger requires the same rotation torque whether the locking of the plunger (6) is locked at the lower end (53) of the axial screw (5) or at its other end, the stick then coming into medium against the sealing cap (110).

Preferably, said propellant device (3) and said plunger (6) are parts cast in a single piece moulded in plastic material, typically of polyolefin, said propellant device (3) being typically selected in a way having mechanical characteristics which are superior, particularly as far as rigidity is concerned, to those of the material constituting said plunger (6).

Figure 1B:
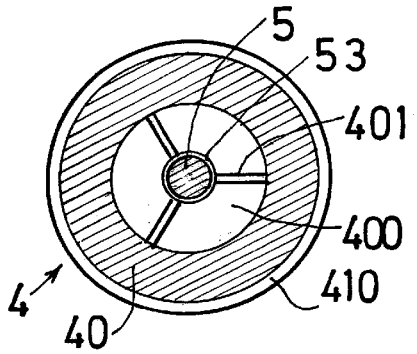
FIG. 1*b* is a view from above of the part cast in a single piece constituted by the base plate (4) and the axial screw (5).
Figure 1C:
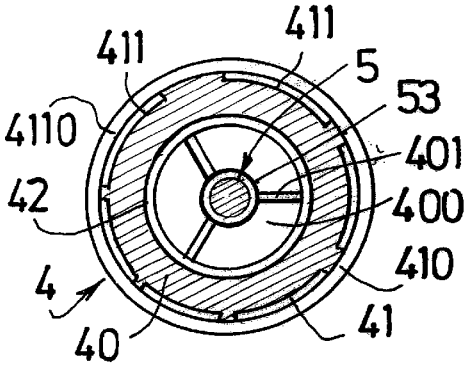
FIG. 1*c*, is a view from below of the part cast in a single piece constituted by the base plate (4) and the axial screw (5).

It is advantageous, as shown in FIGS. 1, 1*b* and 1*c*, for said base plate (4) to include a ceiling (40), typically open by a plurality of apertures forming open-worked sectors (400) separated by radial arms (401), particularly to allow said dispenser (1) to be filled through the bottom, includes a sealed fixing means to said body, typically an external skirt (41) carrying a plurality of parallel fins (410) providing the seal of said dispenser (1) while allowing the rotation of said base plate (4) relative to said body (2) and includes a central skirt (42) the upper part of which includes said open-worked sectors (400) forming apertures, and in which the bottom (12) acting as a knob, includes one or more concentric skirts (120), typically force fitted with the central skirt (42), so as to fix in rotation said bottom (12) and said base plate (4) and to block in a sealed way the lower orifice of said central skirt (42).

As shown in FIG. 1*a*, said body (2) may include, externally, towards its lower and upper ends, a chamfered "top" part (21) and bottom part (22), in such a way that the cap (11) and the bottom (12), once fixed to said body (2), are located externally in the extension of the non-chamfered part of the body, and includes internally two sills for fixing the base plate in the axial direction, one acting as a "top" stop (23) to lock any downward movement of said base plate (4) and therefore to stop it from being able to dissociate itself from the body by passing through its lower orifice (26), the other acting as a "bottom" stop (24) to lock any upward movement of said base plate (4), and therefore to stop it from being able to dissociate itself from the body by passing through its upper orifice (25), the external skirt (41) of the base plate (4) forming a shoulder and flexible tabs (411) with a hook-shaped end (4110), so as to fix propellant device (3) and said body (2) simply by clipping or snapping on, typically irreversibly.

Figure 2B:
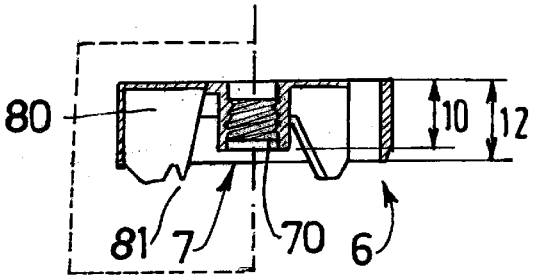
FIG. 2*b* is a side perspective view of a cross-section of the plunger (6) along the vertical axis A—A in FIG. 2*a*.
Figure 2C:
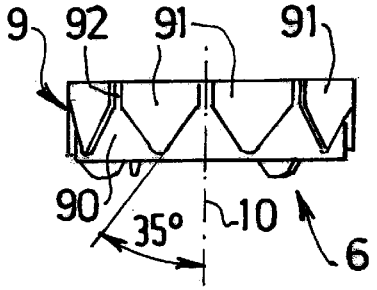
FIG. 2*c* is a side perspective view of the plunger (6).

According to a form of the invention shown in FIGS. 2*b* and 2*c*, said circular belt (9) of said medium (8) may include a continuous internal belt (90) coated on its external surface by a series of patterns in heavy application (91), typically from 6 to 12 patterns, separated from each other by a cut forming said groove (92) and forming a "V" shaped pattern on its lower part, in such a way that said medium (8) can be oriented automatically during assembly of the unit formed by said body (2) and said propellant device (3) with said previously screwed plunger (6), said propellant device (3) being inserted through the upper orifice (25) of said body (1).

Dispensers according to the invention are mainly used for the packaging of cosmetic products, typically deodorants, but they can also be used for the packaging of non cosmetic products, typically adhesives.

Embodiment Examples

Cylindrical dispensers with a capacity of 50 ml and 75 ml have been manufactured, in accordance with FIGS. 1 to 4*a*. The dimensions of these dispensers are as follows:

| | 75 ml dispenser | 50 ml dispenser |
|---|---|---|
| External diameter: | 48 mm | 41.5 mm |
| Internal body diameter: | 41 mm | 35.5 mm |
| Total height | 102 mm | 112 mm |

The detailed dimensions (in mm) of the 75 ml dispensers have been given in FIGS. 2*a* to 3*b*.

The propellant device was moulded in two parts in PE, one part including the base plate (4) integral with the axial screw (5), and one part forming the plunger (6) including the central nut (7), the stick medium (8) and the circular belt (9).

With regard to the engagement between male and female threads, the screw-nut unit was selected according to FIGS. 3*a* to 4*a*, and:

as regards the partial engagement between the axial screw (5) and the nut (7), this was obtained with a screw according to FIG. 4*a*, the angular fraction being about 0.3, each angle $\alpha$ having a value of about 55° (2.55/360=0.305), as regards the up and down thread gradients, they conform to those in FIG. 3*b*, with an angle $\gamma$ equal to +45° and an angle $\gamma'$ equal to −10°, so as to facilitate the disengagement of the nut when the nut is locked in the bottom position, near the lower end (53) of the screw (5), as regards the radial resilience means, this is obtained by a reduced thickness of the wall of the nut. (7), this thinned down wall (72) is of about 0.4 mm and it extends angularly over more than 50% of the circumference, typically between 55 and 70%, and shared out in an approximately even manner around the central axis (10), the remainder of this angular fraction being occupied by reinforcements (73) or by the start of the radial platelets (80).

The plungers (6) were manufactured according to FIGS. 2*a* to 3*b*, as regards therefore the central nut (7), the stick medium (8) and the circular belt (9).

Figure 2A:
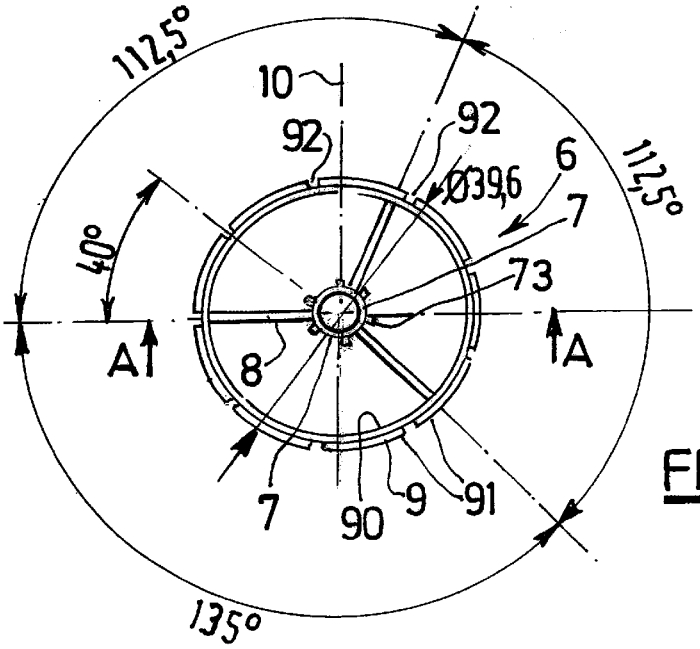

In particular, as shown in FIG. 3*b*, the medium (8) includes 3 platelets (80), approximately set at 120° to each other, as shown in FIGS. 2*a* and 3*a*, each platelet including a flexible tab (81) which will meet the radial arms (401) or the open-worked sectors (400), when the screw (5) is rotated in the direction which sends the plunger (6) downwards, towards the lower end (53) of the axial screw (5). In this case, the plunger (6) is immobilised, being unable to go down any further, the flexible tabs (81), emit a rattle noise at each radial arm (401) clearance and there is disengagement of the screw-nut system, in other words at each turn of the screw (5) there is clearance of the male spirals (50) and female spirals (70), without damage to these spirals, given the means of the invention.

After about a hundred turns no damage has been observed to the screw-nut system providing the movement of the stick.

French Patent Application No. 0004425, filed on Apr. 6, 2000, is incorporated by reference.

| List of references | |
|---|---|
| Dispenser | 1 |
| Axis of Symmetry | 10 |
| Cap | 11 |
| Sealing cap | 110 |
| Bottom | 12 |
| Concentric Skirts | 120 |
| Body | 2 |
| Guide Rib | 20 |
| "Top" chamfered Part | 21 |
| "Bottom" chamfered Part | 22 |
| "Top" stop | 23 |
| "Bottom" stop | 24 |
| Upper orifice | 25 |
| Lower orifice | 26 |
| Propellant device | 3 |
| Base Plate | 4 |
| Ceiling | 40 |
| Open-worked sectors | 400 |
| Radial arms | 401 |
| External Skirt | 41 |
| Sealing fins | 410 |
| Flexible tab | 411 |
| Snap-on hook | 4110 |
| Central skirt | 42 |
| Axial Screw | 5 |
| "Male" thread | 50 |
| Partial thread - threaded angular fraction $\alpha$ | 51 |
| Axial truncation plane | 52 |
| Lower end | 53 |
| Recesses | 54 |
| Radial Distortion | 55 |
| Plunger | 6 |
| Central Nut | 7 |
| "Female" thread | 70 |
| "Up" gradient | 700 |
| "Down" gradient | 701 |
| Partial thread - threaded angular fraction $\beta$ | 71 |
| Thinned down wall | 72 |

-continued

| List of references | |
|---|---|
| Axial reinforcememts | 73 |
| Recesses | 74 |
| Radial Distortion | 75 |
| Non threaded portion | 76 |
| Stick medium | 8 |
| Radial platelets | 80 |
| Flexible tab | 81 |
| Circular belt | 9 |
| Internal belt | 90 |
| Patterns in heavy application | 91 |
| Groove/Cut | 92 |

What is claimed is:

1. A product dispenser, including a body (2), a cap (11), a propellant device (3) including a base plate (4) fixed to said body by assembly, and an axial screw (5), with male helical thread (50), fixed on said base plate, a plunger (6) formed of a medium (8) and of a central nut (7), with a spiral female thread (70), engaging by rotation with said axial screw, a bottom (12) for rotating said axial screw, said medium and said body including axial guide means, by engagement of at least one axial rib (20) on the inner surface of said body with at least one axial groove on the periphery of said medium, so as to provide, in the case of a cylindrical dispenser, axial movement of said stick by rotation of said knob or of said bottom, characterised in that:

a) engagement between the male helical thread (50) and the female thread (70) is partial, one of the two threads extending only over a predetermined angular fraction (51, 71), so as to form a partial thread, b) said central nut (7) and said axial screw (5) including a radial resilience means, for radial distortion under stress, so as to allow, in the event of forced rotation under said stress and of locking of said screw relative to said nut, a disengagement, of the male and female spirals, by overlap of the spirals and clearance of a screw thread, without destroying said engagement between screw and nut, c) said base plate (4) and said medium (8) of said stick include open segments so as to allow said dispenser to be filled through the bottom, d) said medium (8) includes radial platelets (80) fixed to said central nut (7) which has, in the sectors between said radial platelets (80), a thinned down wall (72).

2. A dispenser according to claim 1 wherein said axial screw (5) includes a partial male thread (51) formed on a cylinder truncated by an axial plane.

3. A dispenser according to claim 2 wherein said axial screw (5) includes simultaneously said partial male thread (51) and said radial resilience means.

4. A dispenser according to claim 1 wherein said central nut (7) includes a partial female thread (71) formed on a cylinder truncated by several concurrent axial planes along the axis of symmetry of said dispenser, the angular non threaded part being recessed.

5. A dispenser according to claim 4 wherein said central nut (7) includes simultaneously said partial female thread (71) and said radial resilience means, in the form of a recess (74).

6. A dispenser according to claim 1 wherein said central nut (7) includes said radial resilience means.

7. A dispenser according to claim 6 wherein said thinned down wall (72) has a thickness selected to form said radial resilience means, so as to allow said overlap of threads.

8. A dispenser according to claim 7 wherein said thinned down wall (72) includes radial reinforcements (73).

9. A dispenser according claim 1 wherein said axial screw (5) includes said radial resilience means.

10. A dispenser according to claim 9 wherein said axial screw (5) includes open sectors in the axial direction, so as to form said radial resilience means.

11. A dispenser according to claim 1 wherein said predetermined angular fraction ($\alpha$, $\beta$), over which said engagement extends, is between 0.2 and 0.6.

12. A dispenser according to claim 11 wherein said angular fraction ($\alpha$, $\beta$) is shared out angularly, in an even way relative to the axis (10), so as to obtain an axial symmetry of 2, 3, 4 or 5.

13. A dispenser according to claim 1 wherein, said forced rotation of said axial screw (5) relative to said medium (8) entails the transitory passing of a flexible component, carried by said medium (8), over a raised component carried by said base plate (4), tensioning said flexible component then releasing it after passing said raised component, given the axial bringing together of said medium (8) and said base plate (4), and leads to an emission of an audible sound constituting an audio alert deterring the continuation of rotation in this same direction.

14. A dispenser according to claim 13 wherein said medium (8) includes open sectors and radial platelets (80) integral with a circular belt (9), each radial platelet (80) carrying on its lower part a flexible tab (81), and wherein said base plate (4) includes a ceiling (40) with radial arms (401) delimiting open sectors, arms which, forming said raised component, obstruct the passage of said flexible tab (81), make it vibrate during its forced passage resulting from said forced rotation and thus lead to said emission of an audible sound.

15. A dispenser according to claim 14 wherein said circular belt (9) of said medium (8) includes a continuous internal belt (90) coated on its external surface by a series of patterns in heavy application (91), typically from 6 to 12 patterns, separated from each other by a cut forming said groove (92) and forming a V shaped pattern on its lower part, in such a way that said medium (8) can be oriented automatically during assembly of the unit formed by said body (2) and said propellant device (3) with said previously screwed plunger (6), said propellant device (3) being inserted through the upper orifice (25) of said body (1).

16. A dispenser according to claim 1 wherein said thread (50, 70) is an artillery thread, the up gradients (500, 700) and the down gradients (501, 701) of a characteristic cross-section of the thread of the axial screw (5) and of the central nut (7) being selected to provide simultaneously a thrust in the screw direction in respect of using the cosmetic product and to facilitate said screw thread clearance in the event of down locking of said axial screw (5) relative to said nut (7), at the lower end of said screw.

17. A dispenser according to claim 16 wherein said up gradient (500) of said thread (50) may be between 40 and 50° and wherein said down gradient (501) of said thread (50) is between −5 and −15°.

18. A dispenser according to claim 17 wherein said up gradient $\gamma$ (500) has a value of 45°+/−1° and said down gradient $\gamma'$ (501) has a value of −10°+/−1°.

19. A dispenser according to claim 1 wherein said thread (50, 70) is a standard thread, with up gradients (500, 700) and down gradients (501, 701) identical in absolute value.

20. A dispenser according to claim 1 wherein said propellant device (3) and said plunger (6) are parts cast in a single piece of a plastic material, said propellant device (3)

having mechanical characteristics which are superior, as far as rigidity is concerned, to those of the material constituting said plunger (6).

21. A dispenser according to claim 1 of cylindrical shape, wherein said base plate includes a ceiling (40), and open segments formed by a plurality of apertures forming open sectors (400) separated by radial arms (401), to allow said dispenser (1) to be filled through the bottom, includes a sealed fixing means having carrying a plurality of parallel fins (410) allowing the rotation of said base plate (4) relative to said body (2) while providing the seal of said dispenser (1), and includes a central skirt (42) the upper part of which includes said open sectors (400) forming apertures, and wherein the bottom (12) acting as a knob, includes one or more concentric skirts (120), force fitted with the central skirt (42), so as to fix in rotation said bottom (12) and said base plate (4) and to block in a sealed way the lower orifice of said central skirt (42).

22. A dispenser according to claim 21 wherein said body (2) includes, externally, towards its lower and upper ends, a chamfered top part (21) and bottom part (22), so that the cap (11) and the bottom (12), once fixed to said body (2), are located externally in the extension of the non-chamfered part of the body, and includes internally two sills for fixing the base plate in the axial direction, one acting as a top stop (23) to lock any downward movement of said base plate (4) and therefore to stop it from being able to dissociate itself from the body by passing through its lower orifice (26), the other acting as a bottom stop (24) to lock any upward movement of said base plate (4), and therefore to stop it from being able to dissociate itself from the body by passing through its upper orifice (25), the external skirt (41) of the base plate (4) forming a shoulder and flexible tabs (410) with a hook-shaped end (4110), so as to fix said propellant device (3) and said body (2) by clipping or snapping on, irreversibly.

* * * * *